US005542266A

United States Patent [19]

Suzuki et al.

[11] Patent Number: 5,542,266

[45] Date of Patent: Aug. 6, 1996

[54] REFRIGERATION SYSTEM WITH COMPRESSOR USING REFRIGERATION OIL INSOLUBLE IN REFRIGERANT

[75] Inventors: Etsuro Suzuki; Hideki Kawai, both of Fujisawa; Hiroki Awashima, Sagamihara, all of Japan

[73] Assignee: Matsushita Refrigeration Company, Osaka, Japan

[21] Appl. No.: 309,297

[22] Filed: Sep. 20, 1994

[30] Foreign Application Priority Data

Oct. 20, 1993 [JP] Japan ..... 5-262152
Nov. 5, 1993 [JP] Japan ..... 5-276623

[51] Int. Cl.[6] ..... F25B 43/02

[52] U.S. Cl. ..... 62/469; 62/470

[58] Field of Search ..... 62/468, 469, 470, 62/84, 471, 472

[56] References Cited

U.S. PATENT DOCUMENTS 2,084,341 6/1937 Hornaday ..... 62/469 X
3,411,313 11/1968 Brown et al. ..... 62/468 X
4,518,330 5/1985 Asami et al. ..... 62/469 X
4,730,988 3/1988 Ma ..... 62/469 X
5,355,695 10/1994 Kawaguchi et al. ..... 62/498

FOREIGN PATENT DOCUMENTS 5-157379 6/1993 Japan .

*Primary Examiner*—Harry B. Tanner
*Attorney, Agent, or Firm*—Lowe, Price, LeBlanc & Becker

[57] ABSTRACT

A refrigerating system is provided which includes a refrigerating line through which refrigerant flows, a refrigerant compressor for circulating the refrigerant through the refrigerating line, and an oil separation passage connected to the refrigerant compressor. The refrigerant compressor includes an enclosed chamber storing therein a refrigeration oil insoluble in the refrigerant. The oil separation passage directs the refrigerant introduced from an inlet port of the refrigerant compressor to an outlet port through the enclosed chamber for separating the refrigeration oil contained in the refrigerant entering from the inlet port.

9 Claims, 7 Drawing Sheets

REFRIGERATION SYSTEM WITH COMPRESSOR USING REFRIGERATION OIL INSOLUBLE IN REFRIGERANT

BACKGROUND OF THE INVENTION

1. Technical Field of the Invention

The present invention relates generally to a refrigeration system which may be employed in air conditioners, refrigerators, and the like, and more particularly to an improved compressor for such a refrigeration system which uses a refrigeration oil insoluble in refrigerant.

2. Background of the Related Art

Japanese Patent First Publication No. 5-157379 discloses a conventional refrigeration system as shown in FIG. 8. This refrigeration system includes a horizontal refrigerant compressor 100, a condenser 108, a capillary tube 109, and an evaporator 110. A refrigerant gas introduced through a suction pipe 102 enters a cylinder 103 of the refrigerant compressor 100 so that it is compressed in a compression chamber 104 and is discharged into an enclosed chamber 105. The refrigerant gas discharged in the chamber 105 usually contains much refrigeration oil 106 which is partly separated in the chamber 105, while the remainder thereof is discharged from a discharge pipe 107 to the condenser 108. The refrigeration oil 106 includes oil insoluble in refrigerant for improvement of the electric insulation and the handling of assembling parts. The refrigerant gas introduced into the condenser 108 is subsequently reduced in pressure by the capillary tube 109 and then evaporated in the evaporator 110 for cooling a refrigerating chamber.

The above prior art refrigeration system, however, has suffered from a drawback in that a great volume of the refrigeration oil is discharged into a cooling system (i.e., condenser, capillary tube, and evaporator) together with the refrigerant gas. Particularly, when using a refrigeration oil insoluble in the refrigerant, it becomes difficult to return to the compressor completely. This results in lack of the refrigeration oil in the refrigerant compressor.

Additionally, reducing the viscosity of the refrigeration oil for increasing a returned amount thereof to the compressor gives rise to the problem of wear-out of sliding parts of the compressor.

SUMMARY OF THE INVENTION

It is therefore a principal object of the present invention to avoid the disadvantages of the prior art.

It is another object of the present invention to provide a refrigeration system which is capable of keeping in a refrigerant compressor a given volume of refrigeration oil that is insoluble in refrigerant.

According to one aspect of the present invention, there is provided a refrigeration apparatus which comprises a refrigerating line through which a refrigerant flows, and a refrigerant compressor including a housing which includes an enclosed chamber storing therein a refrigeration oil insoluble in the refrigerant. The housing defines an enclosed chamber for storing a refrigeration oil insoluble in the refrigerant. A suction port is formed in the housing for introducing therethrough the refrigerant via the refrigerating line into the refrigerant compressor. A cylinder is disposed within the housing, having a compression chamber communicating with the suction port, for compressing refrigerant introduced from the suction port. A first discharge port is formed in the housing for discharging therethrough the refrigerant compressed in the compression chamber. The housing and the first discharge port are fluidly insulated from the enclosed chamber. A gas return port is formed in the housing for introducing therethrough the refrigerant discharged from the first discharge port into the enclosed chamber; and a second discharge port is provided in said housing at a given interval away from the gas return port, through which the refrigerant in the enclosed chamber is discharged into said refrigerating line. The apparatus also includes an oil separation passage extending outside the housing of said refrigerant compressor, establishing fluid communication between the first discharge port and the gas return port for separating the refrigeration oil contained in the refrigerant entering from the suction port of the refrigerant compressor.

In the preferred mode, the refrigerant includes a hydrofluorocarbon. The refrigeration oil includes a mineral oil having a kinematic viscosity of less than or equal to 15 cst at 40° C., preferably, less than or equal to 10 cst at 40° C.

The refrigerant compressor includes a housing defining therein the enclosed chamber. The housing has a first end wall and a second end wall opposite the first end wall. The first end wall has the outlet port formed therein, while the second end wall has an oil separation passage inlet port communicating with the oil separation passage to direct the refrigerant flowing therethrough to the enclosed chamber.

The oil separation passage is connected to a compression chamber of the refrigerant compressor to direct to the enclosed chamber of the refrigerant compressor the refrigerant which is introduced from the inlet port and then compressed in the compression chamber.

According to another aspect of the invention, there is provided a refrigerant compressor for use in a refrigeration system which comprises a compressor housing, an enclosed chamber defined within the compressor housing, and a refrigeration oil stored in the enclosed chamber. The refrigeration oil includes a mineral oil, insoluble in a refrigerant circulating the refrigeration system, having a kinematic viscosity of less than or equal to 10 cst at 40° C.

In the preferred mode, an oil pump may further be provided for pumping the refrigeration oil stored in the enclosed chamber. The oil pump includes a rotational shaft and a pump nozzle pumping the refrigeration oil according to rotation of the rotational shaft. The nozzle is arranged eccentrically from the rotational shaft.

The oil pump may alternatively include a rotational shaft and a pump nozzle having fins disposed thereon for stirring the refrigeration oil according to rotation of the rotational shaft.

In addition, a heater may be arranged in the refrigeration oil for mixing the refrigeration oil with the refrigerant.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiment but are for the purpose of explanation and understanding only.

In the drawings.

Figure 3:
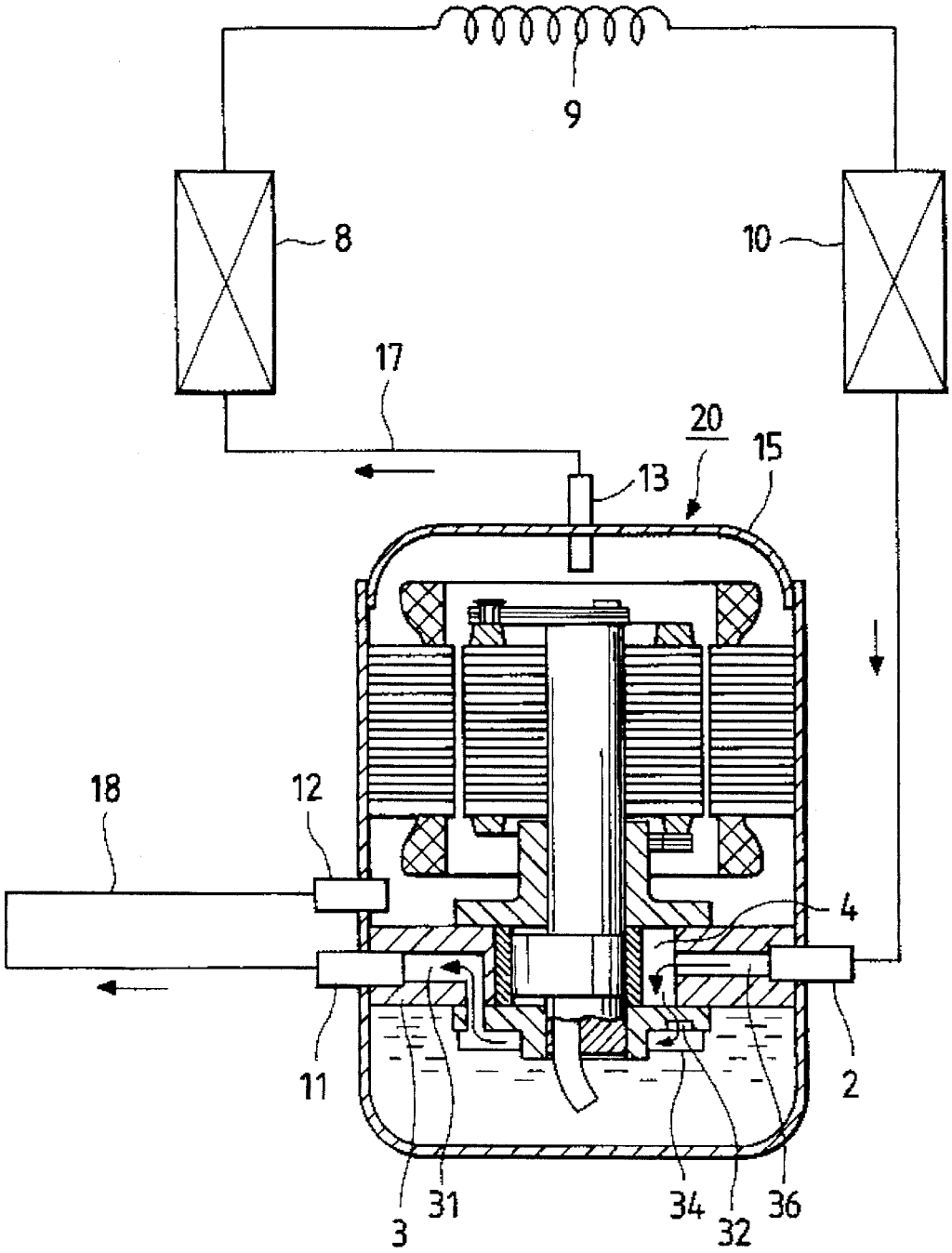
Figure 4:
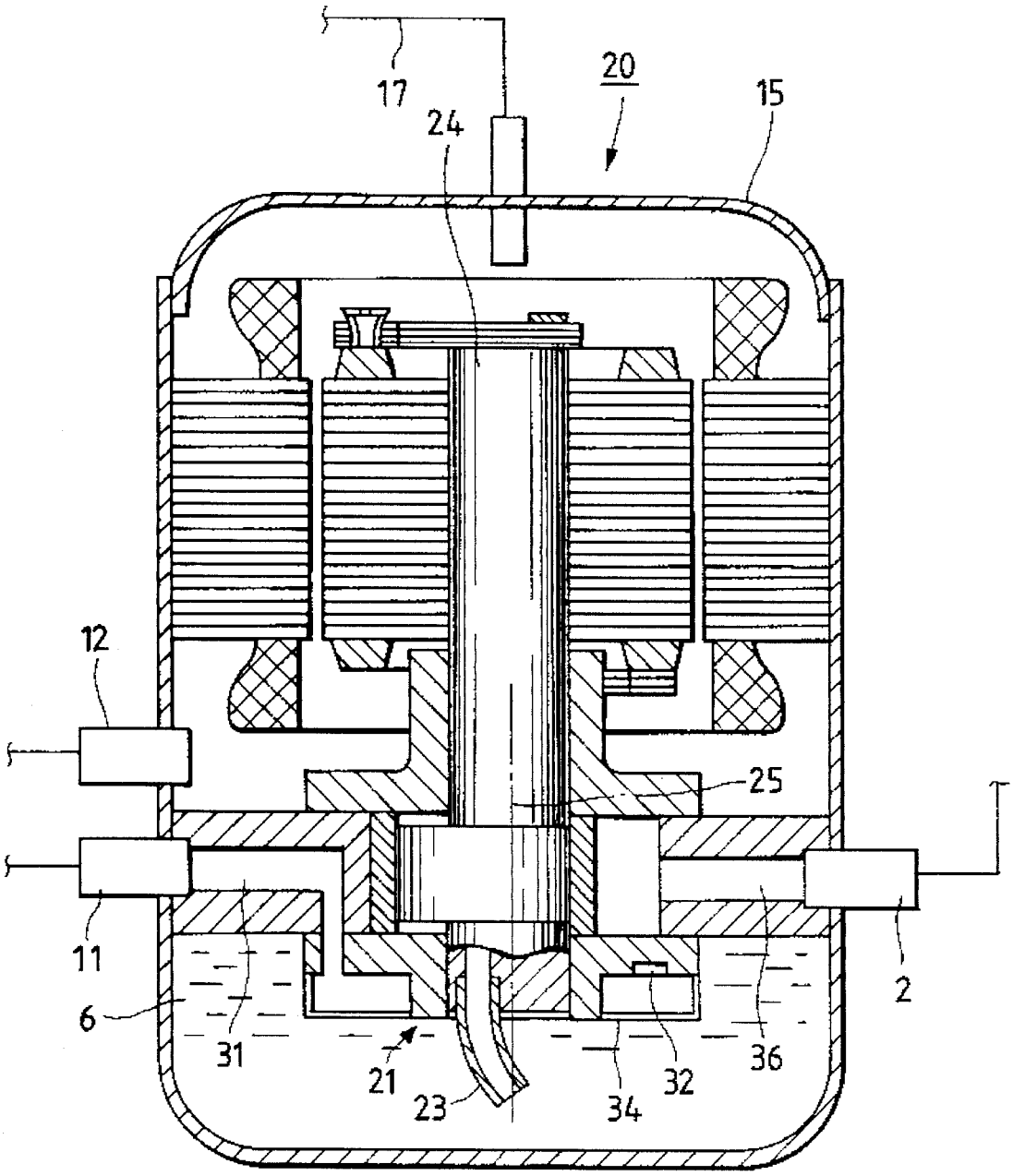
Figure 5:
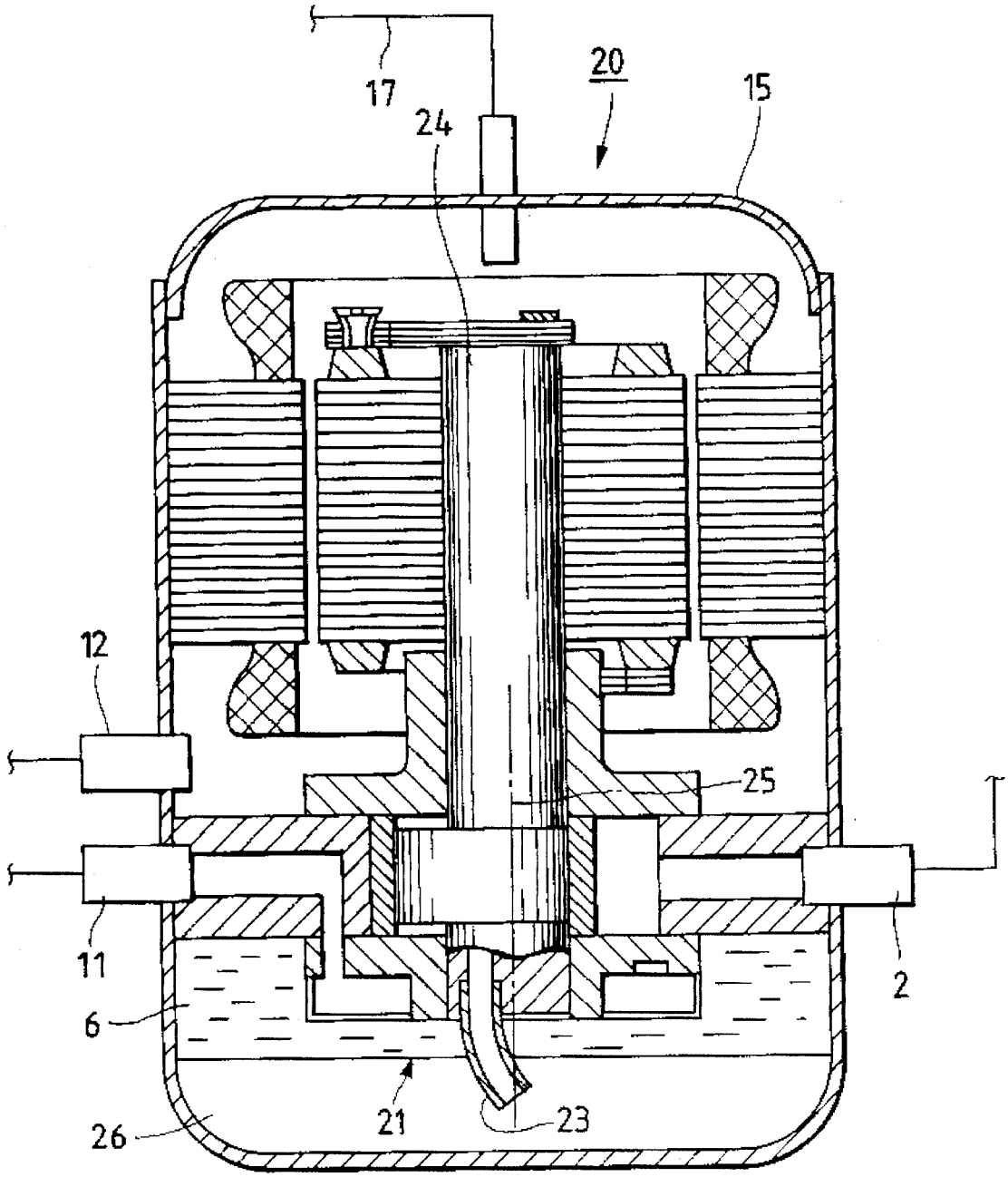
Figure 6:
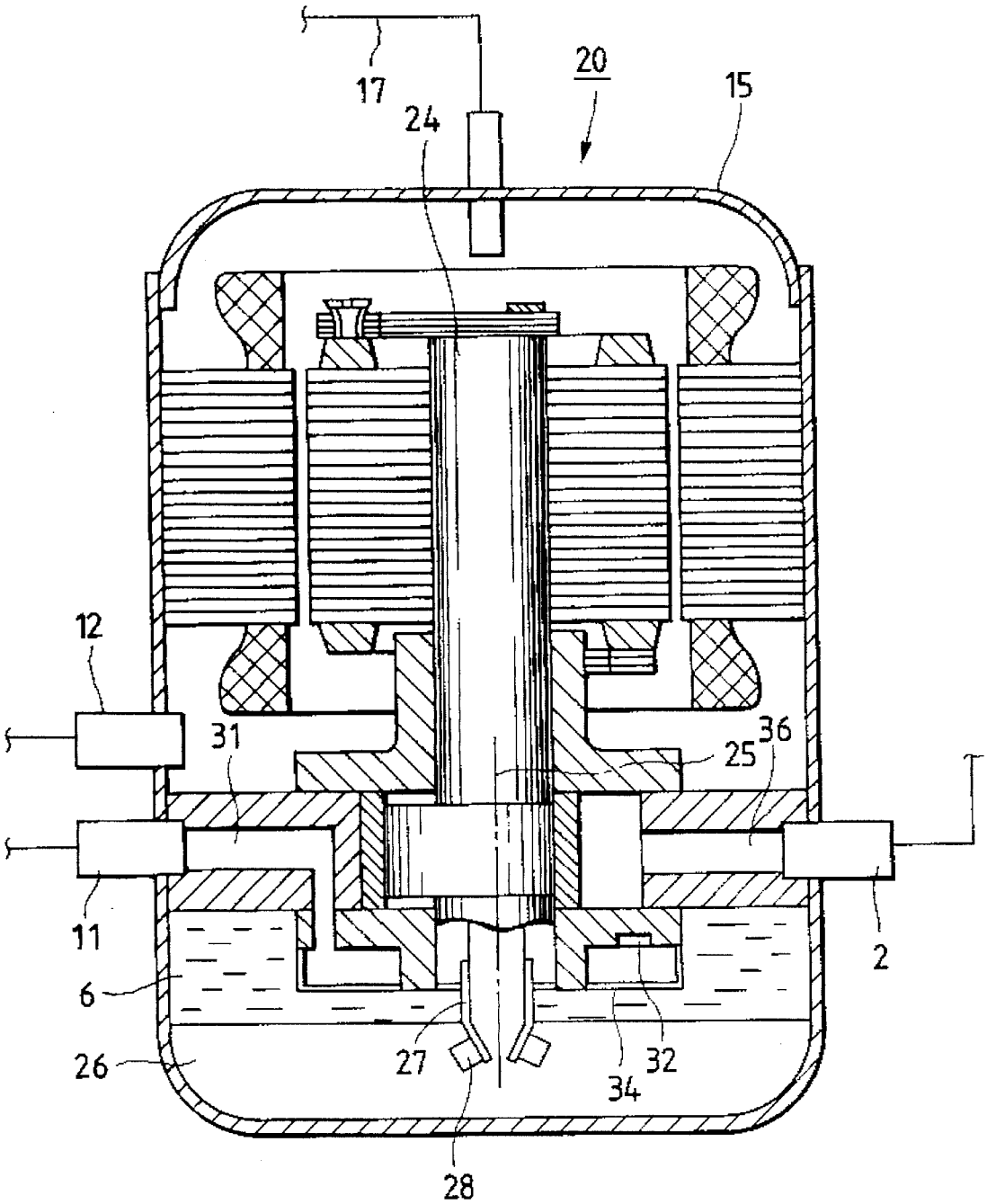
Figure 7:
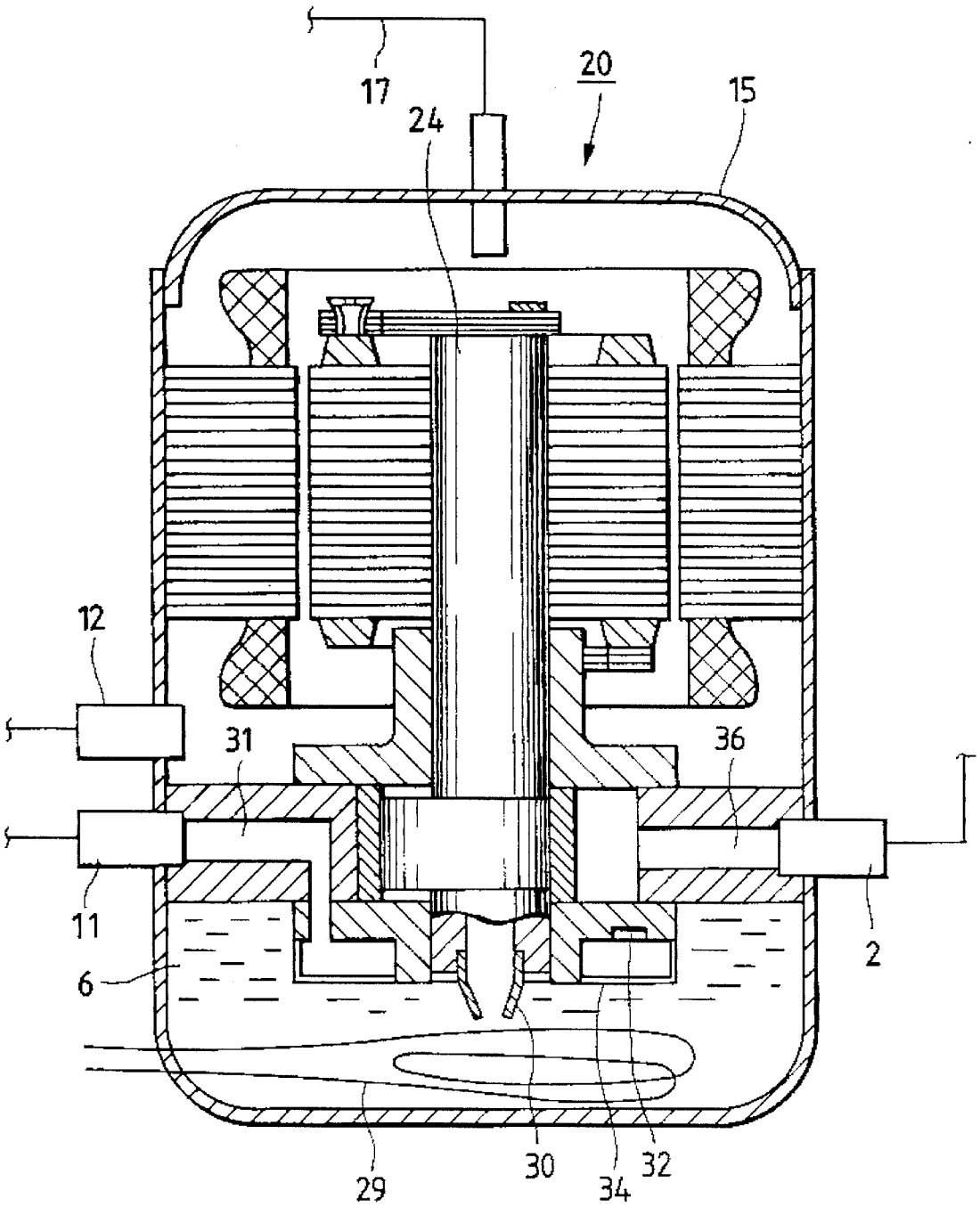
Figure 8:
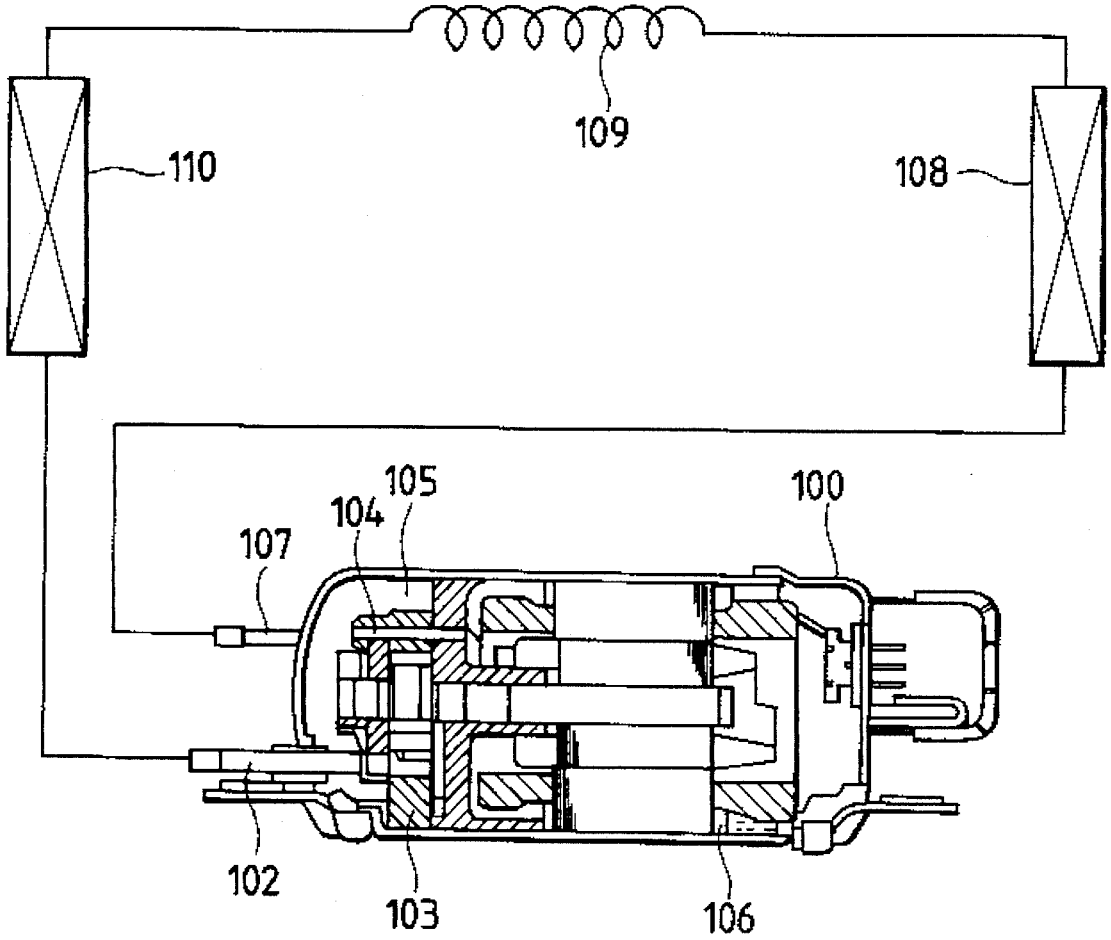
FIG. 8 PRIOR ART

in a simplified cooling system and the kinematic viscosity of the oil at 40° C.;

FIG. 3 is a schematic illustration which shows a refrigeration system of a second embodiment according to the present invention;

FIG. 4 is a cross-sectional view which shows a refrigerant compressor according to a preferred embodiment of the present invention;

FIG. 5 is a cross-sectional view which shows the refrigerant compressor of FIG. 3 when not in operation;

FIG. 6 is a cross-sectional view which shows a modification of a refrigerant compressor;

FIG. 7 is a cross-sectional view which shows another modification of a refrigerant compressor; and FIG. 8 is a schematic diagram which shows a conventional refrigeration system.

DESCRIPTION OF THE PREFERRED EMBODIMENTS

Figure 1:
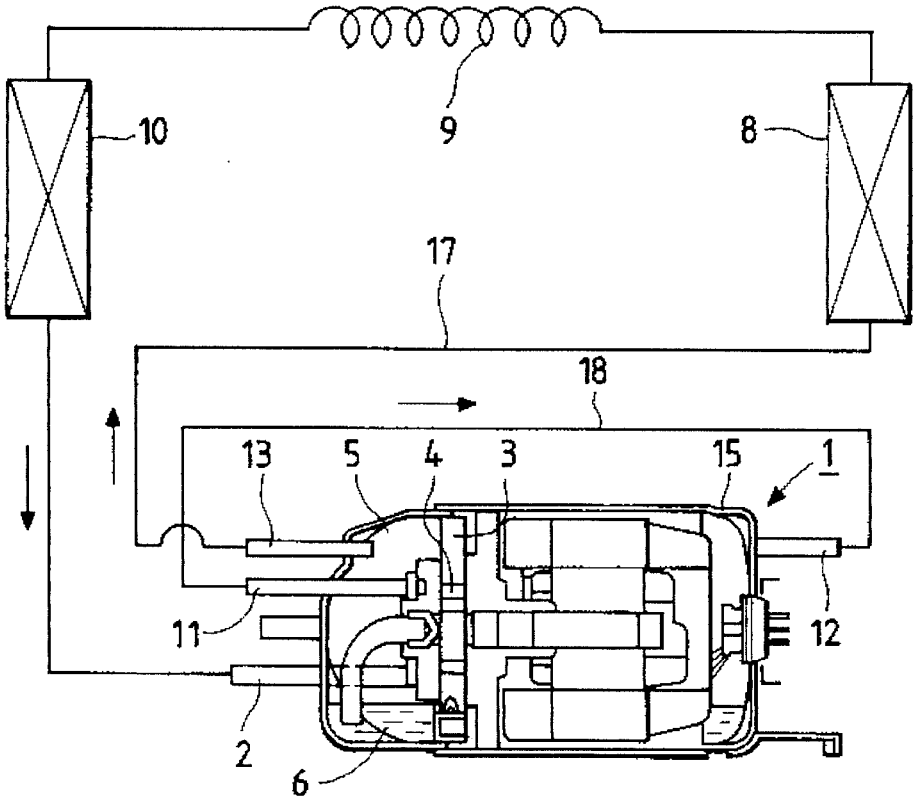
FIG. 1 is a schematic illustration which shows a refrigeration system according to a preferred embodiment of the present invention.

Referring now to the drawings, wherein like numbers refer to like parts in several views, particularly to FIG. 1, there is shown a refrigeration system according to the present invention which may be employed in electric refrigerators or air conditioners.

The refrigeration system includes generally a horizontal refrigerant compressor 1, a condenser 8, a capillary tube 9, an evaporator 10, and a refrigerating line 17 extending therethrough. The evaporator 10 is disposed in a refrigerating chamber (not shown) for cooling the inside thereof.

A refrigerant as used in this refrigeration system includes a main component of hydrofluorocarbon. The refrigerant gas flowing from the evaporator 10 enters a cylinder 3 of the refrigerant compressor 1 through a suction pipe 2 and is compressed in a compression chamber 4. The compressed gas is then discharged directly into an oil separation passage 18, arranged outside the refrigerant compressor 1, extending from a first discharge pipe 11 to a gas return pipe 12, and is returned into an enclosed chamber 5 which is defined in a hermetically sealed housing 15. The gas return pipe 12 is, as can be seen in the drawing, communicates with a gas return pipe inlet port formed in an end wall of the housing 15 opposite an end wall having formed therein an outlet port leading to a second discharge pipe 13. In this way, the refrigerant gas introduced from the evaporator 10 circulates once through the oil separation passage 18 extending from the first discharge pipe 11 to the enclosed chamber 5 through the gas return pipe 12 before it is discharged into the condenser 8. Thus, more refrigeration oil 6 than that in a conventional cooling system such as discussed in the introductory part of this application, is separated from the refrigerant gas in the enclosed chamber 5. This results in a decreased amount of the refrigeration oil 6 going out of the refrigerant compressor 1 together with the refrigerant gas, thereby ensuring a desired amount of the refrigeration oil 6 at all times.

The refrigeration oil 6 used in this embodiment includes oil exhibiting no mutual solubility relative to refrigerant for easy handling of component parts which make up refrigerating machinery against electrical insulation and water contamination.

The refrigerant in the chamber 5 containing a small amount of the refrigeration oil 6 is discharged from the second discharge pipe 13 through the condenser 8 and the capillary tube 9 to the evaporator 10 wherein it is evaporated into a lower temperature level which will cause the refrigeration oil 6 to be accumulated undesirably in the evaporator 10 without returning to the refrigerant compressor 1. For avoiding this drawback, the refrigeration oil 6 has a lower viscosity.

Figure 2:
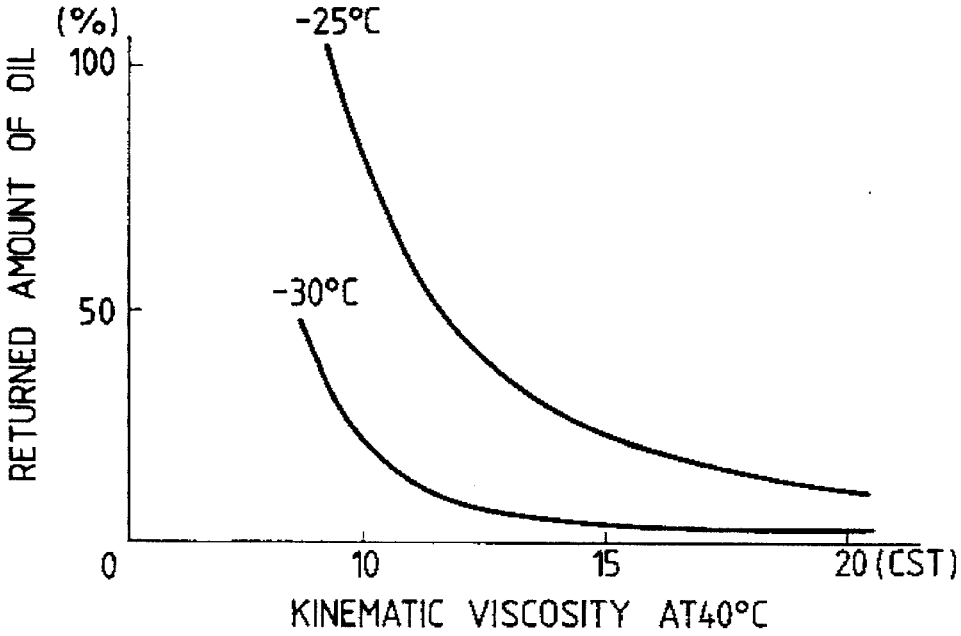
FIG. 2 is a graph which shows the relation between a returned amount of a refrigeration oil at −25° C. and −30° C.

FIG. 2 shows the relation between the returned amount of a refrigeration oil at −25° C. and −30° C. in a simplified cooling system and its kinematic viscosity at 40° C. It will be found that the returned amount of the refrigeration oil is extremely increased below a viscosity of 10 cst (centistoke). Usually, a lower viscosity oil exhibits a lower wear resistance. Accordingly, this embodiment uses a mineral oil as the refrigeration oil 6 for ensuring a desired wear resistance because it generally includes a minor ingredient serving as an extreme pressure material such as sulfur enhancing the wear resistance.

Additionally, the use of a refrigeration oil having a kinematic viscosity of less than or equal to 10 cst at 40° C. also alleviates a problem as discussed below.

In recent years, conventional cooling machines uses, as an alternative to CFC, refrigerant containing a main component of carbon fluoride excluding chlorine (e.g., HFC-134a) and an ester lubricating oil soluble in the refrigerant. These cooling machines, however, encounter the drawback in that the cooling power is reduced with the passing of time due to the fact that organic substances residual in the cooling machine which include cleaning solvents used in manufacturing processes of a refrigerant compressor and an evaporator, are dissolved in the ester lubricating oil into a contamination which will block the flow of refrigerant through a capillary tube.

FIG. 3 shows a refrigeration system of a second embodiment which includes an erect type of refrigerant compressor 20, a condenser 8, a capillary tube 9, and an evaporator 10.

The refrigerant compressor 20 uses a refrigeration oil 6 having a kinematic viscosity of less than or equal to 10 cst at 40° C., and includes generally an oil pump 21 having a pump nozzle 23 fixed on an end of a rotational shaft 24 and a cylinder 3 forming therein a gas inlet path 36 and a compressed gas outlet path 31.

The refrigerant gas flowing from the evaporator 10 enters the gas inlet path 36 through a suction pipe 2 and then is compressed in a compression chamber 4 to an elevated temperature. The compressed gas is, as shown by an arrow, directed inside a discharge cover 34 through a valve 32 and then discharged from a discharge pipe 11 through the compressed gas outlet path 31 to an oil separation passage 18 which leads to a gas return pipe 12 attached in a side wall of a cylindrical housing 15. The compressed gas discharged into the oil separation passage 18 is, similar to the first embodiment, gradually cooled as it flows therethrough to the gas return pipe 12 so that much refrigeration oil 6 contained in the refrigerant gas is separated therefrom.

The gas return pipe 12, as seen in FIG. 3, preferably be arranged as away from a second discharge pipe 13 inserted into an upper wall of the housing 15 as possible for separating more refrigeration oil 6 from the refrigerant gas.

The oil pump 21 is, as shown in FIG. 4, so arranged asymmetrically with respect to the center line 25 of a rotational shaft 24 as to stir the refrigeration oil 6 accumulated in a lower portion of an enclosed housing 15 according to rotation of the shaft 24, pumping the refrigeration oil 6 from a distal end thereof by means of a centrifugal force created by the rotation of the shaft 24.

FIG. 5 shows the refrigerant compressor 20 when the oil pump 21 is not in operation. Liquid refrigerant 26 stays below a layer of the refrigeration oil 6 because its specific gravity is greater than that of the refrigeration oil 6 and it is insoluble in the refrigeration oil 6.

When the oil pump 21 is activated, the refrigeration oil 6 is stirred according to the rotation of the shaft 24. The liquid refrigerant 26 partly gasifies, while the remainder thereof mixes with the refrigeration oil 6, which is, in turn, sucked by the oil pump 21 for lubrication of some sliding component parts.

Referring to FIG. 6, there is shown a modification of the refrigerant compressor 20. This compressor includes an oil pump 27 having disposed on its peripheral surface oil stirring fins 28 which rotate coaxially with the shaft 24. Therefore, even when the refrigeration oil 6 and the refrigerant 26 are separated into two layers, they are easily stirred according to rotation of the shaft 4 so that part of the refrigerant 26 gasifies, while the remainder thereof mixes with the refrigeration oil 6, which is, in turn, pumped by the oil pump 27 for lubrication of any sliding component parts.

FIG. 7 shows another modification of the refrigerant compressor 20. This compressor includes an oil pump 30 and an oil heater 29. The oil pump 30 has a nozzle arranged coaxially with the shaft 24. The oil heater 29 is so arranged within the refrigeration oil 6 as to heat it to mix with the liquid refrigerant. Thus, a mixture of the refrigeration oil and the refrigerant is pumped by the oil pump 30 according to the rotation of the shaft 24.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. Refrigeration apparatus, comprising:

(a) a refrigerant line through which a refrigerant flows;

(b) a refrigerant compressor including a housing defining therein an enclosed chamber storing a refrigeration oil insoluble in the refrigerant, a suction port formed in said housing for introducing therethrough the refrigerant in said refrigerating line into said refrigerant compressor, a cylinder disposed within said housing, having a compression chamber communicating with said suction port, for compressing the refrigerant introduced from said suction port, a first discharge port formed in said housing for discharging therethrough the refrigerant compressed in the compression chamber, said housing, said first discharge port being fluidly insulated from the enclosed chamber, a gas return port formed in said housing for introducing therethrough the refrigerant discharged from said first discharge port into the enclosed chamber; and a second discharge port, provided in said housing at a given interval away from said gas return port, through which the refrigerant in the enclosed chamber is discharged into said refrigerating line; and (c) an oil separation passage extending outside said housing of said refrigerant compressor, establishing fluid communication between said first discharge port and said gas return port for separating the refrigeration oil contained in the refrigerant entering from the suction port of the refrigerant compressor.

2. The apparatus according to claim 1, further comprising:

a condenser, a pressure reducing means, and an evaporator arranged in said refrigerant line.

3. The apparatus according to claim 1, wherein: the refrigerant includes hydrofluorocarbon.

4. The apparatus according to claim 1, wherein:

the refrigeration oil includes a mineral oil having a kinematic viscosity not higher than 10 cst at 40° C.

5. The apparatus according to claim 1, wherein:

said refrigerant compressor is of a horizontal type, and wherein said housing has a first end wall and a second end wall opposite the first end wall, the first end wall having formed therein said first discharge port and said second discharge port, the second end wall having formed therein said gas return port.

6. The apparatus according to claim 1, further comprising:

an oil pump for pumping the refrigeration oil stored in said enclosed chamber, said oil pump including a rotational shaft and a pump nozzle pumping the refrigeration oil according to a rotation of the rotational shaft, the nozzle being arranged eccentricly relative to the rotational shaft.

7. The apparatus according to claim 1, further comprising:

an oil pump for pumping the refrigeration oil stored in said enclosed chamber, said oil pump including a rotational shaft and a pump nozzle having disposed thereon fins for stirring the refrigeration oil according to a rotation of the rotational shaft.

8. The apparatus according to claim 1, further comprising:

an oil pump for pumping the refrigeration oil stored in said enclosed chamber and a heater, said oil pump including a rotational shaft and a pump nozzle designed to pump the refrigeration oil according to a rotation of the rotational shaft, the heater being disposed in the enclosed chamber to heat the refrigeration oil.

9. The apparatus according to claim 1, wherein:

said housing has a selected length and has a first end wall and a second end wall opposite the first end wall in a lengthwise direction of said housing, the first end wall having formed therein said first discharge port and said second discharge port, the second end wall having formed therein said gas return port.

* * * * *